United States Patent [19]

Scanlon

[11] 3,990,366

[45] Nov. 9, 1976

[54] COMPOSITE AMMUNITION CASING WITH FORWARD METALLIC PORTION

[75] Inventor: John J. Scanlon, Monroe, Conn.

[73] Assignee: Remington Arms Company, Inc., Bridgeport, Conn.

[22] Filed: Feb. 6, 1975

[21] Appl. No.: 547,518

[52] U.S. Cl. ..... 102/43 P; 102/44

[51] Int. Cl.[2] ..... F42B 5/26

[58] Field of Search ..... 102/43, 43 P, 44

[56] References Cited

UNITED STATES PATENTS

| | | | |
|---|---|---|---|
| 3,026,802 | 3/1962 | Barnet et al. | 102/43 P |
| 3,099,958 | 8/1963 | Daubenspeck et al. | 102/43 P |
| 3,842,739 | 10/1974 | Scanlon et al. | 102/43 P |

*Primary Examiner*—Verlin R. Pendegrass
*Attorney, Agent, or Firm*—John H. Lewis, Jr.; Nicholas Skovran; William L. Ericson

[57] ABSTRACT

A composite ammunition casing, especially for use in repeating firearms or guns in whose chambers a temperature gradient develops, from a maximum at the forward throat portion to a minimum at the rear breech portion. The casing includes a forward metallic member and a rear member formed of a material having a lower temperature resistance, such as plastic. The casing members have an interlocking junction at a point spaced along the firearm chamber at which the expected local temperature of the chamber drops to a level within the temperature resistance capability of the rear member. The interlocking junction is formed by surface interruptions in the wall of the forward member, into which the material of the rear member projects.

6 Claims, 1 Drawing Figure

COMPOSITE AMMUNITION CASING WITH FORWARD METALLIC PORTION

BACKGROUND AND BRIEF DESCRIPTION OF THE INVENTION

Figure 1:
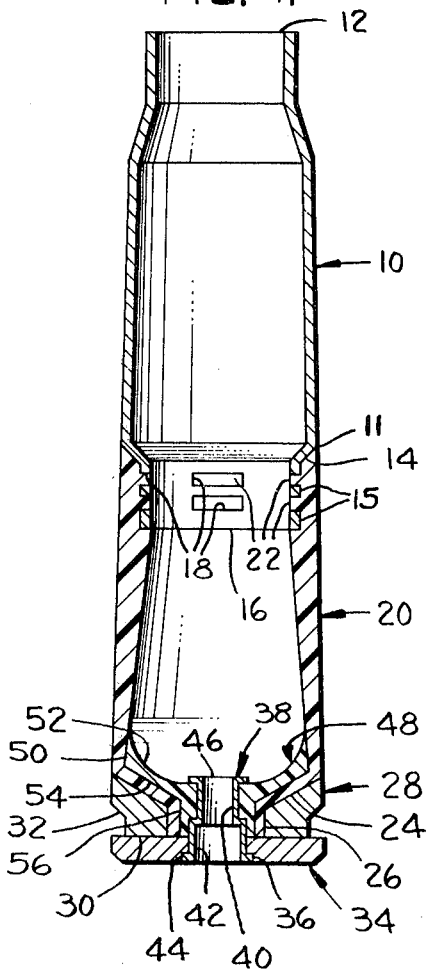

This invention relates to ammunition casings, and more particularly to an improved composite ammunition casing made up of a plurality of component parts, including a tubular metallic forward casing member, a tubular rear casing member, and a head assembly for reinforcing the base of the casing and mounting a primer component.

The principal purpose of composite ammunition casings is to permit the use of dissimilar materials for the components, usually comprising plastic for the casing body and metal for the head assembly, thereby conserving the relatively scarce and expensive metal. Examples of such composite casings are described and claimed, for example, by U.S. Pat. No. 3,745,924 issued July 17, 1973 to John J. Scanlon, and by U.S. Pat. application SER. No. 320,328, filed on Jan. 2, 1973 by H. Jackson Hale, and now U.S. Pat. No. 3,874,294, both of which are assigned to the owner of this application. The mouth portion of the casing may be integrally formed in the casing body, or may be a separate insert, usually of metal. A composite casing of the latter type is described and claimed by U.S. Pat. No. 3,842,739 issued Oct. 22, 1974 to John J. Scanlon et al, and also assigned to the owner of this application.

The general object of the present invention is to reduce, or to eliminate altogether, the need for using relatively expensive plastic materials having high temperature resistance characteristics in composite ammunition casings, particularly in casings of a type intended to be used in repeating guns and firearms whose receiving chambers tend to develop a temperature gradient along their lengths. Further objects and advantages of the invention will appear as the following description proceeds.

Research on repeating firearms and guns, particularly of the military type, has demonstrated that it is advantageous to employ a metal mouth insert with a plastic casing body, such as in the casing disclosed by the aforementioned U.S. Pat. No. 3,842,739. This affords better retention of the projectile, and also places the center of gravity of the casing farther forward than in one made entirely of plastic, so that the casing exhibits dynamic behaviour like that of an all-metal casing although it is lighter in weight. It therefore cooperates more satisfactorily with a standard ejection mechanism.

However, inexpensive plastics having relatively low temperature-resistance characteristics, such as polysulfones and polyethylenes, which are satisfactory for ammunition casings for many firearms, especially those of the smaller calibers, are precluded from use in ammunition casings of previously-known designs for many repeating firearms, and for guns of larger calibers. The receiving chambers of such firearms become heated upon firing, with a temperature gradient ranging from a maximum at the forward throat of the chamber to a minimum at the rear breech portion. Illustratively, this gradient may range from 550° to 330° F. in a typical 30mm gun. To avoid casing failure, it has previously been necessary to use a relatively expensive plastic having a high temperature-resistance characteristic, such as a tetrafluoroethylene polymer, for the bodies of composite casings to be used in such weapons. The plastic may comprise about half the casing weight, especially in larger calibers such as 20 and 30mm, so that the expense becomes excessive.

Briefly stated, according to a preferred embodiment thereof, I carry out my invention by forming a composite ammunition casing from a metallic forward tubular casing, and a rear tubular casing made of a material having a lower temperature-resistance characteristic than the metal of the forward casing. This material may be one of the less expensive plastics such as polyester, polysulfone, or polyethylene polymers.

The forward metallic casing member is extended rearwardly a substantial distance from its mouth, and meets the rear casing member at a distance which is to be selected on the basis of a determination of the temperature gradient to be encountered in the type of firearm or gun in which the casing is to be used, and the limit of temperature resistance of the particular material chosen for the rear casing member. The junction is located at a distance from the mouth of the casing at which the temperature of the chamber drops below the upper limit which is tolerable by the rear casing without excessive loss of strength.

The forward and rear casing members are connected at this junction by an interlocking gas-sealing joint, which preferably is formed by interruptions in the wall surface of the forward casing member, into which some of the material of the rear casing member projects. The term "interruptions" is employed to generally describe recesses, holes, threads or the like in the otherwise tubular forward casing wall. If the rear casing member is formed of an initially-flowable plastic material, the joint is preferably completed by insert molding, that is, by molding the rear casing member with the forward casing member inserted in the mold, so that the projections of the rear casing into the discontinuities of the forward casing are formed in situ. The interlocking joint may, however, be formed by threads, by cement if of sufficient strength for the purpose, or by other known securing means.

The rear casing member terminates in a base portion, to which a head assembly of known type may be attached.

DESCRIPTION OF THE DRAWING AND THE PREFERRED EMBODIMENT

While the specification concludes with claims particularly pointing out the subject matter which I regard as my invention, it is believed that a clearer understanding may be gained from the following detailed description of a preferred embodiment thereof, referring to the accompanying drawing, in which:

FIG. 1 is a cross-sectional view of a preferred form of the improved ammunition casing.

The improved casing incorporates a forward tubular casing member 10 of a metallic material such as aluminum, brass, or steel, and a rear tubular casing member 20 of a material less resistant to high temperatures. The material of the rear casing member may be any of a number of plastics such as polyester, polysulfone, or polyethylene, polymers, whose temperature resistances differ considerably from one another, but are all less than that of the metal forward casing. The less expensive plastics may be used even though they have lower temperature resistance, provided that they will not melt or degrade at the temperatures to be encountered near the rear or breech portion of the receiving chamber of the firearm for which the casing is designed. This is permitted according to the invention by extending the metallic forward casing 10 rearwardly from its projectile-receiving mouth 12 to a junction point 11 with the rear casing 20 which is spaced sufficiently far from the throat of the receiving chamber of the intended firearm so that the expected chamber temperature has dropped to a level which is within the capacity of the rear casing material to resist. Since the chamber temperature declines from a maximum at its forward throat to a minimum at its rear breech, this junction point may be spaced as far from the mouth of the casing toward the base as is necessary to accommodate a given plastic and the temperature gradient expected in the chamber of a given firearm or gun. It will not be a difficult matter for those skilled in the art, given a particular range and gradient of chamber temperatures, along with conventional design parameters, to select the most economical combinations of casing member lengths and materials.

An interlocking, gas-sealing joint between the casing member 10 and 20 is made at the junction 11. According to a feature of the invention, the interlocking joint is formed by holes, recesses, threads or other surface interruptions in the tubular wall of one of the casing members, and the insertion, e.g. by molding, of portions of the other casing member into these surface interruptions. In the preferred form shown, the surface interruptions take the form of a series of circumferentially-spaced slots 18, which extend through a reduced-diameter skirt portion 16 connected to the rear of the casing member 10 by a frusto-conical portion 14. The rear casing member 20 is formed by known insert molding procedures, with the forward casing member 10 in situ. The material of the member 20 flows into the slots 18 to form insert lugs 22, which cooperate with intervening portions 15 of the skirt 16 to form a smooth tubular interior wall through the joint region.

The ammunition casing also includes a reinforcing head assembly attached to the base of the casing member 20. This assembly includes a bridge insert 48 having a suitably-contoured inner surface 52, frusto-conical outer surfaces 50 and 54 conforming to the internal configuration of the casing 20, and a hollow stem portion 56 which fits within a tubular skirt 26 at the base of the casing. The casing member 20 may be insert molded to final form with the bridge insert 48 in situ, or molded with an enlarged opening in the base and later reduced conformably about the insert, as by cold-working, or otherwise assembled with the bridge insert in a manner appropriate to the materials and forms of a given casing design. A reinforcing sleeve 28 is next assembled over the skirt 26 and against a frusto-conical base portion 24 of the casing, and an extraction rim 34 is placed against a base surface so of the sleeve. A circumferential recess 32 formed in the sleeve cooperates with the rim 34 to provide an extraction groove for the casing. The head assembly is completed and secured by inserting a tubular cup member 38 into a central opening formed through the rim 34 and the bridge insert 48, and flaring its forward initially-tubular tip 46 outwardly to lie against the forward surface of the bridge insert. A circumferential flange 44 extends about the cup member 38 and fits into a recess 36 in the rear surface of the rim 34 to hold the rim in place.

The cup member 38 is provided with a cylindrical recess 42 for receiving a conventional primer component (not shown), and with a tubular flash-hole 40 for communicating the primer with a charge of propellant (not shown) which is placed in the casing when it is subsequently loaded.

What I claim is:

1. A composite ammunition casing comprising:

a tubular forward casing member formed of a metallic material resistant to relatively high temperatures encountered in the forward throat portion of repeating firearm chambers, said forward casing member having a mouth portion of a first diameter for receiving a projectile in gas-sealing relation therein, and flaring rearwardly through a substantial portion of the length of the composite casing into a rear portion of a second diameter greater than said first diameter;

a tubular rear casing member formed of a plastic material of lower temperature resistance than said forward casing member, having a temperature resistance of the order of polyester or polyethylene, but capable of withstanding the relatively low temperatures encountered in the rear breech portions of repeating gun chambers, said rear casing member having a forward termination in the region of said rear portion of said forward casing member, and having a rear base portion;

said rear portion of said forward casing member forming a junction with said rear casing member, said forward and rear casing members abutting and being provided with interlocking gas-sealing means at said junction, said junction being located rearwardly of said mouth portion at a distance at which the gun chamber temperature to be encountered is within the temperature resistance capability of the material of said rear casing member.

2. A casing as recited in claim 1, in which said rear portion of said forward casing member terminates rearwardly in a tubular skirt portion of reduced diameter formed with at least one surface interruption in the region of said junction, said rear casing member overlapping said skirt portion and extending inwardly into said interruption to form said interlocking means.

3. A casing as recited in claim 1, in which said rear casing member is insert molded with said forward casing member in situ to form said interlocking means.

4. A casing as recited in claim 3, in which said forward casing member has a tubular wall portion formed with at least one surface interruption in the region of said junction, said plastic material being molded into said interruption to form said interlocking means.

5. A casing as recited in claim 3, in which said rear portion of said forward casing member is formed with a plurality of circumferentially-spaced surface interruptions in the region of said junction, said plastic material being molded into said interruptions to form said interlocking means.

6. A casing as recited in claim 5, said interruptions comprising openings formed with radial extent through said rear portion, said plastic material extending through said openings.

* * * * *